US009320671B2

(12) United States Patent
Gelfand et al.

(10) Patent No.: US 9,320,671 B2
(45) Date of Patent: Apr. 26, 2016

(54) ERGONOMIC CRUTCH GRIPS

(71) Applicant: Lightbulb, LLC, Franklin, TN (US)

(72) Inventors: Matt Gelfand, Nashville, TN (US); Rich Crim, Franklin, TN (US); Joe Webster, Franklin, TN (US)

(73) Assignee: Lightbulb, LLC, Franklin, TN (US)

( * ) Notice: Subject to any disclaimer, the term of this patent is extended or adjusted under 35 U.S.C. 154(b) by 115 days.

(21) Appl. No.: 13/667,382

(22) Filed: Nov. 2, 2012

(65) Prior Publication Data

US 2013/0146111 A1 Jun. 13, 2013

Related U.S. Application Data

(60) Provisional application No. 61/555,775, filed on Nov. 4, 2011.

(51) Int. Cl.
*A61H 3/02* (2006.01)

(52) U.S. Cl.
CPC ..... *A61H 3/02* (2013.01); *A61H 2201/1635* (2013.01); *Y10T 16/476* (2015.01)

(58) Field of Classification Search
CPC ..... A61H 3/02; A61H 2201/1635; A61H 2003/0233; Y10S 16/12; Y10S 16/90; Y10T 16/476
USPC ..... 135/65, 68, 71–72, 76; 16/110.1, 421, 16/422, 430
See application file for complete search history.

(56) References Cited

U.S. PATENT DOCUMENTS 1,509,778 A * 9/1924 Raymond ..... 135/68
2,856,943 A * 10/1958 Sparlin ..... 135/68
3,269,399 A 8/1966 Smith
3,517,678 A 6/1970 Gilsdorf
4,572,227 A 2/1986 Wheeler
4,637,414 A * 1/1987 Urban ..... 135/73
4,838,291 A * 6/1989 DiVito ..... 135/68
5,351,701 A * 10/1994 Hsiao ..... 135/68
5,417,234 A * 5/1995 Davis ..... 135/68
5,725,005 A * 3/1998 Yamasaki et al. ..... 135/73

(Continued)

FOREIGN PATENT DOCUMENTS

JP 06086793 A * 3/1994 ..... A61H 3/02

OTHER PUBLICATIONS

International Search Report for corresponding application No. PCT/US2012/063299, Jan. 31, 2013, 8 pages (not prior art).

*Primary Examiner* — Winnie Yip
(74) *Attorney, Agent, or Firm* — Patterson Intellectual Property Law, P.C.; Ryan D. Levy

(57) ABSTRACT

A set of ergonomic handgrips and arm pads make the use of crutches or other walking assist devices more comfortable and less likely to cause repetitive stress injuries. A metacarpal protrusion of the each handgrip is angled outward at about 5 to 25 degrees from front to back when installed to place the user's wrists at a more ergonomic angle (approximately 15 degrees inward rotation). The metacarpal protrusion produces a substantially flat surface with a downward slope. Each handgrip spreads the load out over the hand of the user eliminating pressure. The handgrips can be fitted on crutches, a walker, a cane, or another walking assist device. The arm pad has a pair of protrusions that produce a recess on the side facing away from a user's chest which engages a user's arm and keeps the crutch top positioned correctly while the crutch is in use by the user.

18 Claims, 6 Drawing Sheets

(56) References Cited

U.S. PATENT DOCUMENTS

| | | | | | |
|---|---|---|---|---|---|
| 5,761,767 | A * | 6/1998 | Barton | ..... | 16/430 |
| 5,848,603 | A * | 12/1998 | Urban | ..... | 135/71 |
| 6,055,998 | A * | 5/2000 | Bader | ..... | 135/69 |
| 6,988,295 | B2 * | 1/2006 | Tillim | ..... | 16/430 |
| 7,537,017 | B2 | 5/2009 | Baker | | |
| 2008/0314426 | A1 | 12/2008 | Estrada, Jr. | | |
| 2010/0058558 | A1 * | 3/2010 | Wang | ..... | 16/421 |
| 2013/0263901 | A1 * | 10/2013 | Severson et al. | ..... | 135/72 |

* cited by examiner

ERGONOMIC CRUTCH GRIPS

CROSS-REFERENCES TO RELATED APPLICATIONS

This application claims benefit of the following patent application which is hereby incorporated by reference: U.S. Provisional Application No. 61/555,775, filed Nov. 4, 2011.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

This invention relates to an apparatus which provides for improved crutches and canes by providing ergonomic handgrips and arm pads therefor.

Millions of people each year are directed by doctors to use crutches temporarily while they heal from an injury. A standard set of aluminum crutches has an arm pad and a handgrip on each crutch. The handgrip forces the user's wrists to be at an unnatural angle, while the padding is not sufficient and creates pressure points in the hands which can be uncomfortable. Similarly, the armpit pad produces pressure points that cause the crutches to be uncomfortable. Further, prolonged use of such crutches can lead to repetitive stress injuries.

BRIEF SUMMARY OF THE INVENTION

In one aspect of the invention, a set of ergonomic handgrips and arm pads make the use of crutches or other walking assist devices more comfortable. The handgrips may be constructed of a rigid plastic insert and soft rubber outer skin. They may be angled outward at about 15 degrees (5 to 25 degree range) from front to back when installed to place the user's wrist at a more ergonomic angle (approximately 15 degrees inward rotation). The unique profile of the handgrip spreads the load out over the hand of the user, eliminating pressure points and making the handgrip much more comfortable to use and less likely to cause repetitive stress injuries during prolonged use. The handgrips can be retrofitted to a standard set of aluminum 2-pole crutches, to a walker, to a cane, or to another walking assist device. The contoured arm pad may be constructed of flexible polyurethane foam with a soft upholstered cover. The arm pad may include a pair of protrusions that produce a recess on one side (i.e., a side facing away from a user's chest) to engage a user's arm and keep the crutch top positioned correctly while the crutch is in use.

In one aspect of the invention, a handgrip is operable to mount on a walking assist device. The handgrip has a front end corresponding to a lateral side of the hand of a user of the handgrip, a back end corresponding to a medial side of the hand of the user, a topside corresponding generally to a palm side of the hand of the user, a bottom side corresponding generally to a distal phalanges portion of the hand of the user, an outside corresponding to a proximal and intermediate phalanges portion of the hand of the user, an inside corresponding to a palm of the hand of the user, and a longitudinal axis. The handgrip may include a substantially rigid core having a metacarpal protrusion operable to support the metacarpals of the hand of the user. The metacarpal protrusion extends toward the outside from the longitudinal axis at an angle between 5 and 25 degrees from the front and to the back end of the handgrip.

In another aspect of the invention, an arm pad is operable to mount to a top of a crutch. The arm pad has a bottom facing generally downward when in use by a user, a top facing generally upward when in use by the user, an inside facing a chest of the user when in use by the user, an outside facing an arm of a user when in use by the user, a front generally facing the same direction as the front of the user when in use by the user, and a back generally facing the same direction as the back of the user when in use by the user. The arm pad includes a main block, a first protrusion, and a second protrusion. The main block is operable to mount at the top of the crutch. The first protrusion may be integral with the main block, and extends outwardly from an outside surface of the main block adjacent the front of the arm pad. The second protrusion may be integral with the main block and extends outward from the outside surface of the main block adjacent the back of the arm pad. A recess is formed between the first protrusion and the second protrusion and is operable to receive an arm of the user when the arm pad is in use by the user.

In another aspect of the invention, a crutch is operable to support a user during ambulatory movement (i.e., to aid a user in walking). The crutch includes a first crutch pole, a second crutch pole, and arcuate top support, and a handgrip. The arcuate top support extends between and beyond a top of the first crutch pole, and a top of the second crutch pole. The handgrip has a front end corresponding to a lateral side of the hand of a user of the handgrip, a back end corresponding to a medial side of the hand of the user, a topside corresponding generally to a palm side of the hand of the user, a bottom side corresponding generally to a distal phalanges portion of the hand of the user, and outside corresponding to a proximal and intermediate phalanges portion of the hand of the user, an inside corresponding to a palm of the hand of the user, and a longitudinal axis. The handgrip may include a substantially rigid core having a metacarpal protrusion operable to support the metacarpals of the hand of the user. The metacarpal protrusion extends toward the outside from the longitudinal axis at an angle between 5 and 25 degrees from the front and to the backend of the handgrip.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Although described herein in the context of handgrips for a standard aluminum crutch, it is contemplated within the scope of the claims that the handgrips may be applied to other walking (i.e., ambulatory movement) assist devices such as canes and walkers. Further, as used herein, "walking" refers to hobbling, limping, shuffling, or any other type of ambulatory movement, and "walking assist devices" refers to devices designed to aid in such movement including, but not limited to crutches, canes, and walkers.

Figure 1:
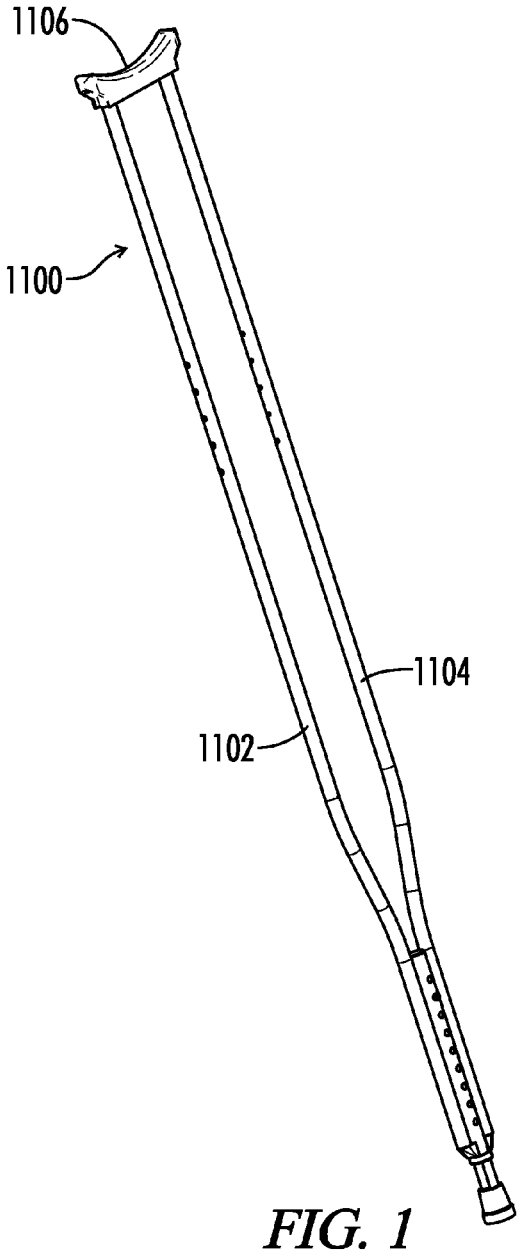
FIG. 1 (PRIOR ART)
FIG. 1 is a perspective view of a standard 2 pole aluminum crutch known in the prior art.

Referring to prior art FIG. 1, a standard aluminum 2 pole crutch 1100 is shown without an arm pad and a handgrip. The crutch 1100 includes a first crutch pole 1102 and a second crutch pole 1104. An arcuate top support 1106 extends between a top of the first crutch pole 1102 and a top of the second crutch pole 1104 and beyond the first and second crutch poles 1102, 1104. Prior art arm pads simply encase the top, inside, and outside of the arcuate top support 1106 with a predetermined, constant thickness of padding (e.g., rubber, neoprene, foam, etc.). Prior art handgrips are substantially or completely tubular, although they may have a slight bulge in the middle and are covered with a constant thickness of padding. When a user places the user's weight on a prior art tubular handgrip, a pressure point is thus created at the heel of the hand of the user. Further, because the arm pad is merely concave in the vertical direction, the user must squeeze the arm pad into the user's armpit to keep the crutch 1100 in place while supporting the user's weight on the handgrip and while moving the crutch 1100 while walking.

Figure 2:
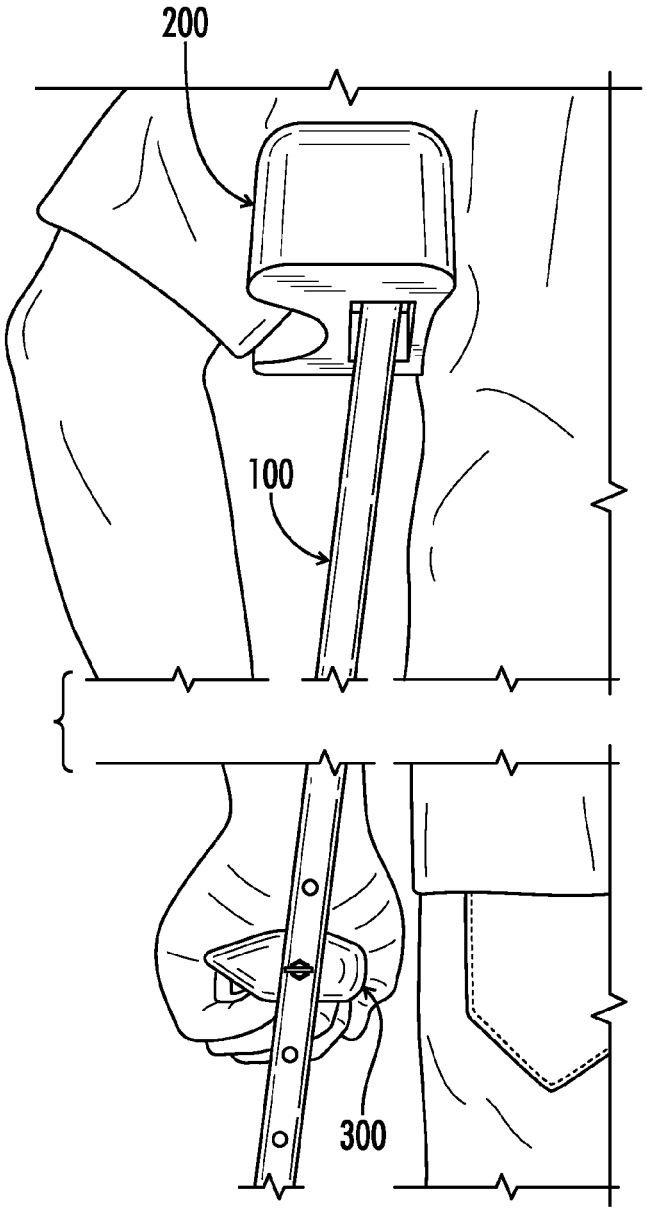
FIG. 2 is a perspective view of a user using a left crutch.

Referring to FIG. 2, a user is using a crutch 100 to aid in ambulatory movement (i.e., to support the user while the user is walking). The crutch 100 is a standard 2 pole aluminum crutch including an arm pad 200 at a top of the crutch 100, and a handgrip 300 near the middle of the crutch 100. The arm pad 200 fits between the chest and arm of the user, and the user holds the handgrip 300 and the user's hand. The arm pad 200 maintains the crutch in alignment with the arm, while the user places his weight on the handgrip 300, and maintains the top of the crutch 100 in position while repositioning the crutch 100 while walking.

Figure 5:
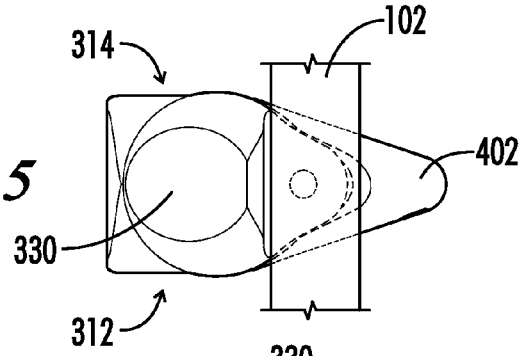
FIG. 5 is a front perspective view of a left handgrip mounted on a crutch.
Figure 3:
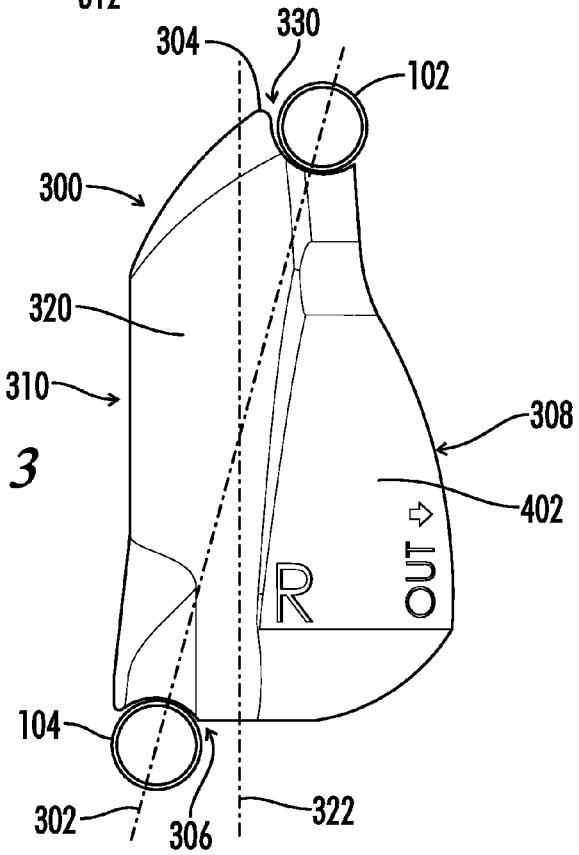
FIG. 3 is a top perspective view of a right handgrip.
Figure 4:
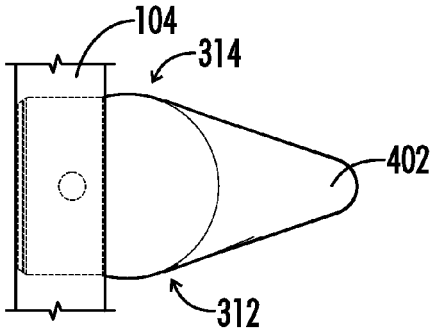
FIG. 4 is a rear perspective view of a right handgrip mounted on a crutch.
Figure 6A:
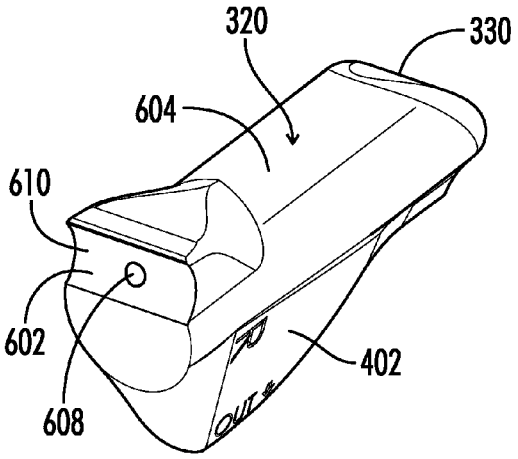
FIG. 6A is a rear, top, inside isometric view of a right handgrip.
Figure 6C:
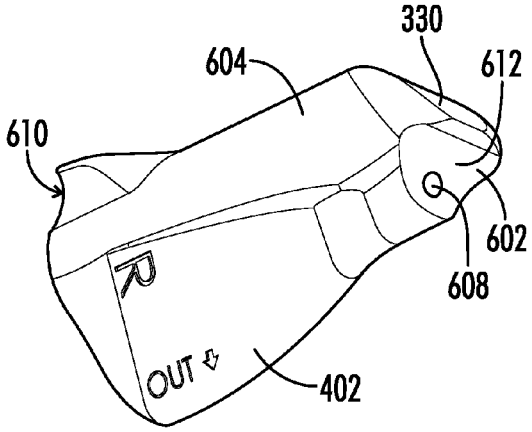
FIG. 6C is a front, top, outside isometric view of a right handgrip.
Figure 6B:
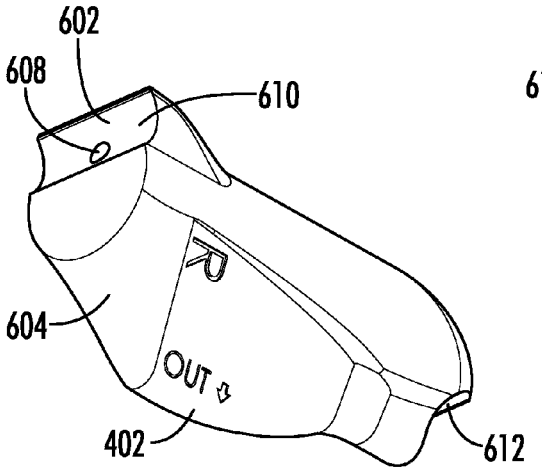
FIG. 6B is a rear, top, outside isometric view of a right handgrip.
Figure 6D:
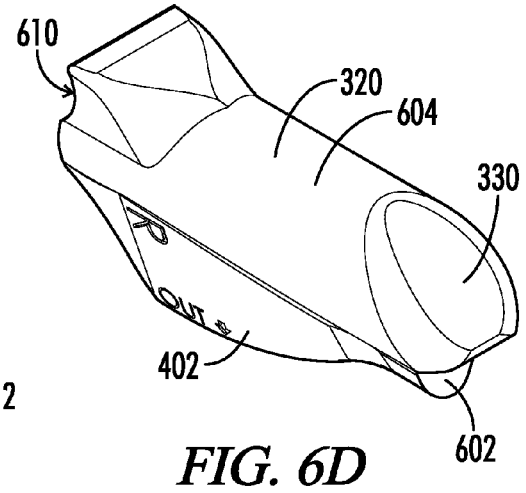
FIG. 6D is a front, top, inside isometric view of a right handgrip.

Referring to FIG. 3, the handgrip 300 is mounted on a standard 2 pole aluminum crutch between a first crutch pole 102 and a second crutch pole 104 (i.e., mounted on a walking assist device). The handgrip 300 has a longitudinal axis 302 extending along a line between the first crutch pole 102 and the second crutch pole 104 in this embodiment. When in use by the user, the handgrip 300 has a predetermined orientation. The handgrip 300 has a front end 304 corresponding to a lateral side of the hand of the user and generally adjacent the first crutch pole 102 in this embodiment. The handgrip 300 has a back end 306 corresponding to a medial side of the hand of the user and generally adjacent the second crutch pole 104 in this embodiment. An outside 308 of the handgrip 300 corresponds generally to the proximal and intermediate phalanges portion of the hand of the user. An inside 310 of the handgrip 300 corresponds generally to a thumb of the hand of the user. Referring to FIGS. 4 and 5, a top side 314 of the handgrip 300 corresponds generally to a palm of the hand of the user. A bottom side 312 of the handgrip 300 corresponds generally to a distal phalanges portion of the hand of the user. Left hand and right hand handgrips 300 are the same, but because of the difference in spatial relationship between the front and the outside, they are essentially mirror images of one another (i.e., a metacarpal protrusion 402 extends to the outside which is inverted between right and left hand handgrips with respect to the front).

Referring to FIGS. 3, 4, 5, 6A, 6B, 6C, and 6D, the handgrip 300 includes a metacarpal protrusion 402 which supports metacarpals of the hand of the user when in use by the user. The metacarpal protrusion 402 extends toward the outside 308 from the longitudinal axis 302 at an angle between about 5 and 25 degrees from the front end 304 to the back and 306 of the handgrip 300 (see particularly FIG. 3). In an optional embodiment, the metacarpal protrusion 402 extends outwardly from the longitudinal axis 302 at an angle of approximately 15 degrees. In a further optional embodiment, the handgrip 300 includes a generally tubular center section 320. The tubular center section 320 has a center line 322 at an angle between about 5 and 25 degrees relative to the longitudinal axis 302 of the handgrip 300 toward the inside 310 from the back end 306 to the front end 304. Additionally, the centerline 322 may have an angle of about 15 degrees relative to the longitudinal axis 302. The generally tubular center section 320 and the metacarpal protrusion 402 cooperate to maintain the wrist of the user at an inward angle of approximately 15 degrees and eliminate pressure points when the handgrip 300 is in use by the user. In one embodiment, the metacarpal protrusion 402 is substantially flattened section designed to spread the load of the user across the entire palm of the user instead of directly onto the heel of the hand of the user. The metacarpal protrusion 402 slopes downward from the generally tubular center section 320 at about 5 to 25 degrees (about 15 degrees in one embodiment) to further reduce stress on the wrist of the user. In one embodiment, the generally tubular center section 320 includes an indentation 330 at the front end 304 of the handgrip 300 having a contour generally conforming to an angle of the thumb of the hand of the user.

Referring to FIGS. 6A, 6B, 6C, and 6D the handgrip 300 includes or may be formed of substantially rigid core 602 at least partially covered by a resilient material 604. The resilient material 604 contacts the hand of the user when the handgrip 300 is in use by the user (i.e., held by the user). In one embodiment, a substantially rigid core 602 is a rigid plastic or polyurethane and the resilient material is rubber, synthetic rubber, or a fabric such as neoprene which may be lined with spandex. In one embodiment, the handgrip 300 includes a central bore 608 substantially parallel to longitudinal axis 302. The central bore 608 is operable to receive a mounting element of the walking assist device (e.g., crutch 100). In one embodiment, the mounting element of the walking assist device is a mounting bolt of the crutch 100. The mounting bolt passes through the first crutch pole 102, through the central bore 608 of the handgrip 300, and through the second crutch pole 104 to affix the handgrip 300 to the crutch 100. In one embodiment, the handgrip 300 includes a first crutch pole recess 612 and a second crutch pole recess 610. The first crutch pole recess 612 is operable to engage the first crutch pole 102, and the second crutch pole recess 610 is operable to engage the second crutch pole 104. The first and second crutch pole recesses 612, 610 maintain the handgrip 300 in an upright position with respect to the first and second crutch polls 102, 104.

Figure 7:
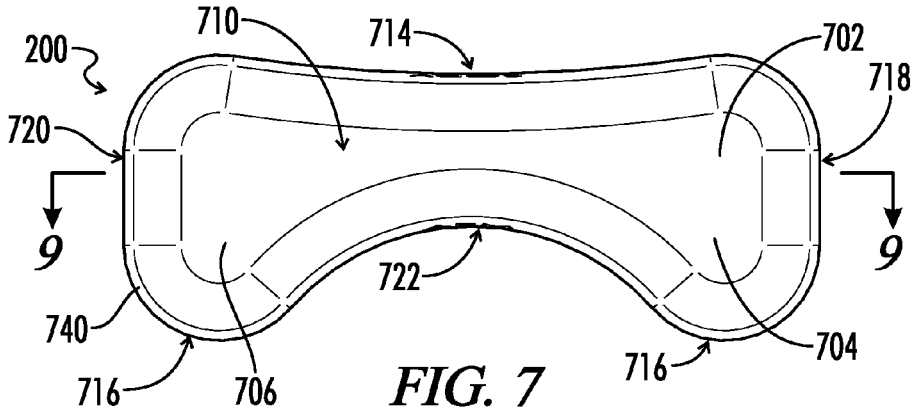
FIG. 7 is a top perspective view of an arm pad.
Figure 8:
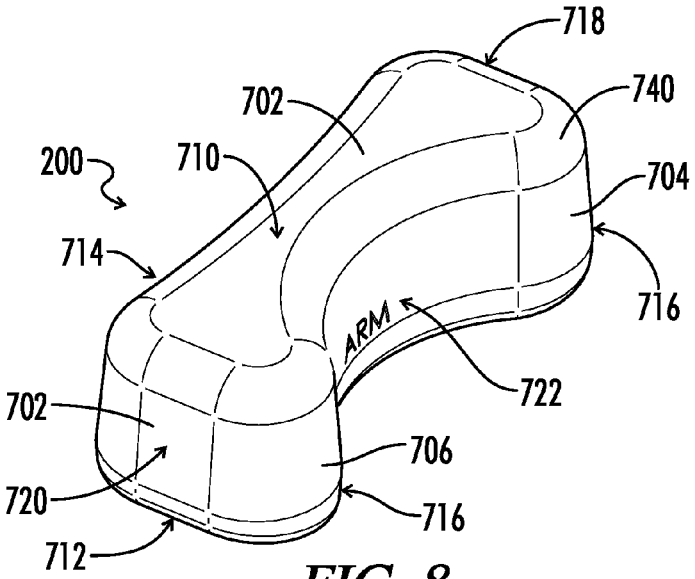
FIG. 8 is a perspective isometric view of an arm pad.
Figure 9:
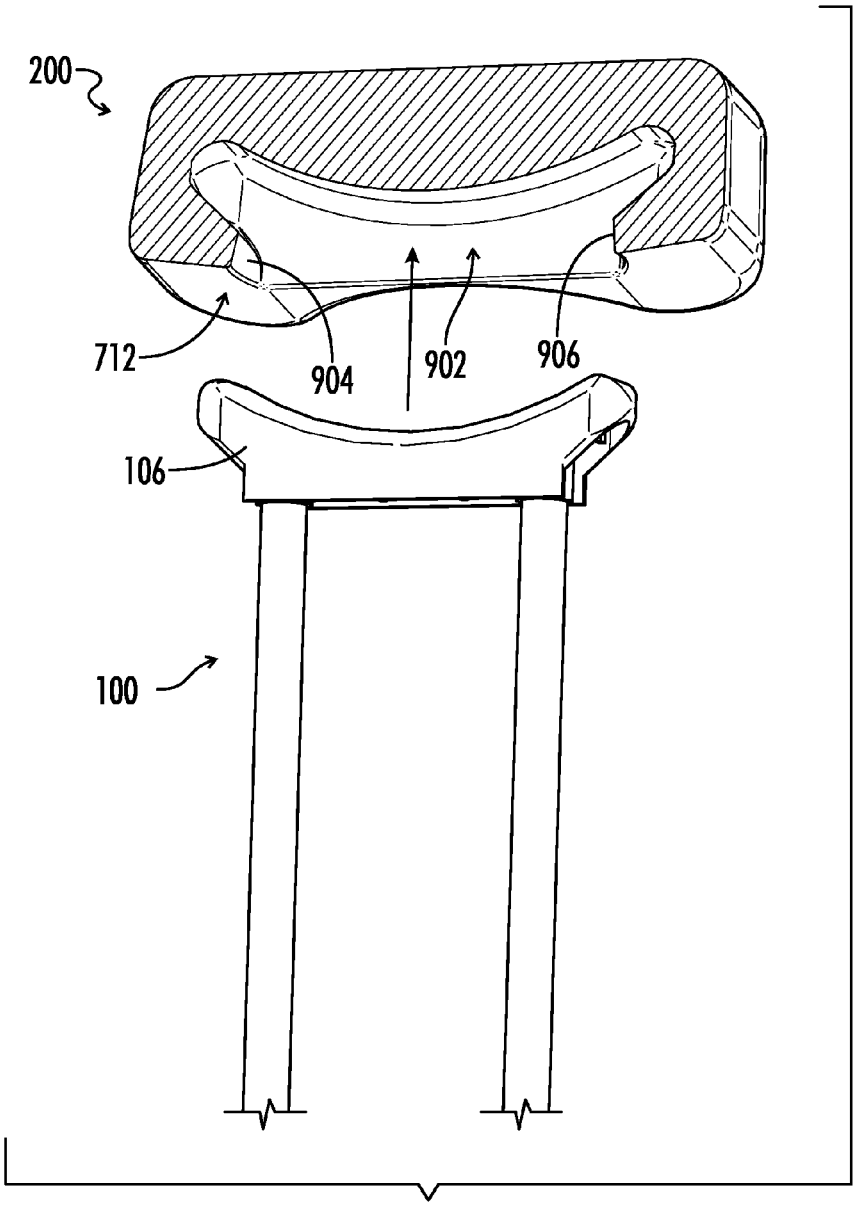
FIG. 9 is a depressed perspective cutaway view of an arm pad.

Referring to FIGS. 7, 8, and 9, the arm pad 200 includes a main block 702, a first protrusion 704, and a second protrusion 706. The arm pad 200 is operable to mount at the top of the crutch 100. When mounted on the crutch 100 and in use by a user, the arm pad 200 has a predetermined orientation. A top 710 of the arm pad 200 generally faces upward. A bottom 712 of the arm pad 200 generally faces downward. An inside 714 of the arm pad 200 faces a chest of the user. An outside 716 of the arm pad 200 faces an arm of the user. A front 718 of the arm pad 200 generally faces the same direction as a front of the user (i.e., the direction of movement of the user when walking forward). A back 720 of the arm pad 200 generally faces the same direction as a back of the user (i.e., the opposite direction of a direction of movement when the user is walking forward).

The main block 702 is operable to mount to the top 106 of the crutch 100. The first protrusion 704 is integral with the main block 702 and extends outwardly from the outside 716 of the main block 702 adjacent the front 718 of the arm pad 200. The second protrusion 706 is integral with the main block 702 and extends outwardly from the outside 716 of the main block 702 adjacent the rear 720 of the arm pad 200. First protrusion 704 and second protrusion 706 form a recess 722 operable to receive an arm of the user when the arm pad 200 is used by the user. The first and second protrusions 704, 706 generally extend vertically from the top to the bottom of the arm pad 200. The first protrusion 704 and second protrusion 706 cooperate to retain the arm of the user within the recess 722 and maintain the crutch 100 in the proper position while the user is using the crutch 100 to aid in walking (i.e., any type of ambulatory movement). In one embodiment, the main block 702 extends generally equidistant from the inside and outside of the crutch 100 while the first and second protrusions 704, 706 extend outwardly such that the arm pad 200 extends further outwardly than inwardly. In one embodiment, an inside 714 of the main block 702 is substantially flat, a top 710 of the main block 702 is substantially flat, and at least one edge 740 (e.g., a top edge 740) of the main block 702 is rounded. In one embodiment, the arm pad 200 is formed of polyurethane foam and covered with a relatively soft material on at least the inside 714, top 710, and outside 716.

Referring to FIG. 9, the main block 702 of the arm pad 200 also includes a mounting recess 902. The mounting recess 902 is operable to receive the arcuate top support 106 of the crutch 100 (see FIG. 2). The main block 702 the arm pad 200 also includes a first lip 904, and a second lip 906. The first lip 904 is operable to extend under a portion of the arcuate top support 106 extend to be on the first crutch pole 102. The first lip 904 retains the arcuate top support 106 in the mounting recess 902 when the arcuate top support 106 is received in the mounting recess 902. The second lip 906 is operable to extend under a portion of the arcuate top support 106 extending beyond the second crutch pole 104. The second lip 906 retains the arcuate top support 106 in the mounting recess 902 when the arcuate top support 106 is received in the mounting recess 902.

In one embodiment, a cane has a handgrip 300. The handgrip 300 is mounted to a handle of the cane such that the handgrip 300 does not rotate, and the metacarpal protrusion 402 extends laterally from the handle of the cane when the cane is in an upright position. Similarly, in one embodiment, a walker has a pair of handgrips 300 (i.e., a right handgrip 300 and a left handgrip 300). The handgrips 300 are mounted to the walker such that the handgrips 300 do not rotate, and the metacarpal protrusions 402 extend laterally from the walker when the walker is in an upright position.

In one embodiment, the handgrip 300 is secured to the first and second crutch poles 102, 104 by pins extending from the handgrip 300 along the longitudinal axis 302. In another embodiment, the handgrip 300 is secured to the crutch poles 102, 104 by clips generally aligned with the longitudinal axis 302.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful ERGONOMIC CRUTCH GRIPS, it is not intended that such references be construed as limitations upon the scope of this invention except as set forth in the following claims.

What is claimed is:

1. A handgrip operable to mount on a walking assist device, said handgrip having a front end corresponding to a lateral side of a hand of a user of the handgrip, a back end corresponding to a medial side of the hand of the user, a top side corresponding generally to a palm of the hand of the user, a bottom side corresponding generally to a distal phalanges portion of the hand of the user, an outside corresponding to a proximal and intermediate phalanges portion of the hand of the user, an inside corresponding to a thumb of the hand of the user, and a longitudinal axis, said handgrip comprising:

a metacarpal protrusion operable to support metacarpals of the hand of the user, wherein the metacarpal protrusion extends toward the outside from the longitudinal axis at an angle between 5 and 25 degrees from the front end to the back end of the handgrip; and a generally tubular center section having a centerline at an angle between about 5 and 25 degrees relative to the longitudinal axis of the handgrip toward the inside from the back end to the front end.

2. The handgrip of claim 1, further comprising a substantially rigid core and a resilient material covering at least a portion of the substantially rigid core contacting the hand of the user when in use by the user.

3. The handgrip of claim 1, further comprising a substantially rigid core and a resilient material covering at least a portion of the substantially rigid core contacting the hand of the user when the handgrip is in use by the user, wherein the substantially rigid core comprises rigid plastic, and the resilient material comprises rubber or synthetic rubber.

4. The handgrip of claim 1, wherein the metacarpal protrusion extends outwardly from the longitudinal axis at an angle of approximately 15 degrees.

5. The handgrip of claim 1, wherein the generally tubular center section comprises an indentation at the front end of the handgrip having a contour operable generally conforming to an angle of a thumb of a hand of the user.

6. The handgrip of claim 1, wherein handgrip has a central bore substantially parallel to the longitudinal axis, and the central bore is operable to receive a mounting element of the walking assist device.

7. The handgrip of claim 1, wherein the walking assist device is a crutch having a first crutch pole and a second crutch pole, wherein the handgrip further comprises a first crutch pole recess in the front end operable to receive the first crutch pole and a second crutch pole recess in the back end operable to receive the second crutch pole such that the handgrip is maintained in an upright position with respect to the crutch when the handgrip is mounted to the crutch.

8. The handgrip of claim 1, wherein the handgrip in combination with the walking assist device.

9. The handgrip of claim 1, wherein the handgrip in combination with the walking assist device, wherein the walking assist device is one of a cane, a crutch, or a walker.

10. A crutch operable to aid a user in walking, said crutch comprising:

a first crutch pole;

a second crutch pole;

an arcuate top support extending between a top of the first crutch pole and a top of the second crutch pole and beyond the first and second crutch poles; and a handgrip having a front end corresponding to a lateral side of a hand of the user, a back end corresponding to a medial side of the hand of the user, a top side corresponding generally to a palm side of the hand of the user, a bottom side corresponding generally to a distal phalanges portion of the hand of the user, an outside corresponding to a proximal and intermediate phalanges portion of the hand of the user, an inside corresponding to a thumb of the hand of the user, and a longitudinal axis, said handgrip comprising:

a metacarpal protrusion operable to support metacarpals of the hand of the user, wherein the metacarpal protrusion extends toward the outside from the longitudinal axis at an angle between 5 and 25 degrees from the front end to the back end of the handgrip; and a generally tubular center section having a centerline at an angle between about 5 and 25 degrees relative to the longitudinal axis of the handgrip toward the inside from the back end to the front end.

11. The crutch of claim 10, wherein the metacarpal protrusion extends outwardly from the longitudinal axis at an angle of approximately 15 degrees.

12. The crutch of claim 10, wherein the handgrip has a central bore substantially parallel to the longitudinal axis, and the crutch further comprises a mounting element passing through the central bore and engaging the first crutch pole and the second crutch pole to secure the handgrip to the first and second crutch poles, wherein the mounting element is a mounting bolt, and wherein the handgrip further comprises a first crutch pole recess engaging the first crutch pole and a second crutch pole recess engaging the second crutch pole, wherein the first and second crutch pole recesses maintain the handgrip in an upright position with respect to the first and second crutch poles.

13. The crutch of claim 10 further comprising:

an arm pad having a bottom facing generally downward when in use by a user, a top facing generally upward when in use by the user, an inside facing a chest of the user when in use by the user, an outside facing an arm of a user when in use by the user, a front generally facing the same direction as a front of the user when in use by the user, and a back generally facing the same direction as a back of the user when in user by the user, said arm pad comprising:

a main block operable to mount at the arcuate top support of the crutch;

a first protrusion integral with the main block extending outwardly from an outside surface of the main block adjacent the front of the arm pad; and a second protrusion integral with the main block extending outwardly from the main block adjacent the back of the arm pad, wherein a recess is formed between the first protrusion and the second protrusion, said recess operable to receive an arm of the user when the crutch is used by the user.

14. A crutch operable to aid a user in walking, said crutch comprising:

a first crutch pole;

a second crutch pole;

an arcuate top support extending between a top of the first crutch pole and a top of the second crutch pole;

an arm pad configured to mount at the arcuate top support having a bottom facing generally downward when in use by a user, a top facing generally upward when in use by the user, an inside facing a chest of the user when in use by the user, an outside facing an arm of a user when in use by the user, a front generally facing the same direction as a front of the user when in use by the user, and a back generally facing the same direction as a back of the user when in user by the user, said arm pad comprising:

a main block;

a first protrusion integral with the main block extending outwardly from an outside surface of the main block adjacent the front of the arm pad; and a second protrusion integral with the main block extending outwardly from the main block adjacent the back of the arm pad, wherein a recess is formed between the first protrusion and the second protrusion, said recess operable to receive an arm of the user when the crutch is used by the user;

a handgrip having a front end corresponding to a lateral side of a hand of the user, a back end corresponding to a medial side of the hand of the user, a top side corresponding generally to a palm side of the hand of the user, a bottom side corresponding generally to a distal phalanges portion of the hand of the user, an outside corresponding to a proximal and intermediate phalanges portion of the hand of the user, an inside corresponding to a thumb of the hand of the user, and a longitudinal axis, said handgrip comprising:

a metacarpal protrusion operable to support metacarpals of the hand of the user, wherein the metacarpal protrusion extends toward the outside from the longitudinal axis at an angle between 5 and 25 degrees from the front end to the back end of the handgrip; and a generally tubular center section having a centerline at an angle between about 5 and 25 degrees relative to the longitudinal axis of the handgrip toward the inside from the back end to the front end.

15. The crutch of claim 14, wherein the arm pad comprises a polyurethane foam.

16. The crutch of claim 14, wherein the handgrip has a central bore substantially parallel to the longitudinal axis, and the crutch further comprises a mounting element passing through the central bore and engaging the first crutch pole and the second crutch pole to secure the handgrip to the first and second crutch poles, wherein the mounting element is a mounting bolt, and wherein the handgrip further comprises a first crutch pole recess engaging the first crutch pole and a second crutch pole recess engaging the second crutch pole, wherein the first and second crutch pole recesses maintain the handgrip in an upright position with respect to the first and second crutch poles.

17. The crutch of claim 14, wherein the metacarpal protrusion extends outwardly from the longitudinal axis at an angle of approximately 15 degrees.

18. The crutch of claim 14, wherein the main block of the arm pad further comprises:

a mounting recess operable to receive the arcuate top support;

a first lip operable to extend under a portion of the arcuate top support extending beyond the first crutch pole and retain the arcuate top support in the mounting recess when the arcuate top support is received in the mounting recess; and a second lip operable to extend under a portion of the arcuate top support extending beyond the second crutch pole and retain the arcuate top support in the mounting recess when the arcuate top support is received in the mounting recess.

* * * * *